United States Patent [19]

Pavio

[11] 4,375,054

[45] Feb. 22, 1983

[54] SUSPENDED SUBSTRATE—3 dB MICROWAVE QUADRATURE COUPLER

[75] Inventor: Anthony M. Pavio, Plano, Tex.

[73] Assignee: Rockwell International Corporation, El Segundo, Calif.

[21] Appl. No.: 231,570

[22] Filed: Feb. 4, 1981

[51] Int. Cl.[3] ..... H01P 5/18

[52] U.S. Cl. ..... 333/116; 333/238

[58] Field of Search ..... 333/116

[56] References Cited

U.S. PATENT DOCUMENTS 3,593,208 7/1971 Smith ..... 333/116 X
3,621,478 11/1971 Johnson et al. ..... 333/116
3,659,228 4/1972 Napoli ..... 333/116

FOREIGN PATENT DOCUMENTS 2833772 2/1980 Fed. Rep. of Germany ..... 333/116

OTHER PUBLICATIONS

Napoli, 3 dB Directional Coupler, RCA Technical Notes, TN No. 987, Nov. 26, 1974.

*Primary Examiner*—Paul L. Gensler
*Attorney, Agent, or Firm*—Michael E. Taken; V. Lawrence Sewell; Howard R. Greenberg

[57] ABSTRACT

A −3 dB microwave quadrature coupler is provided on a single layer dielectric substrate and employs only two conductor coupling lines and a relatively wide, cost efficiently manufacturable coupling gap. The substrate is suspended within a mounting case providing a minimum spacing above and below the substrate. The ground plane is on the bottom of the substrate. Microstrip conductor ports are on the top of the substrate and are connected to a pair of parallel spaced coplanar conductor lines on top of the substrate juxtaposed a cut-out region of the ground plane therebelow. The coplanar conductor lines are balanced and coupled to each other, not to the ground plane nor to the mounting case. The coupler is compact, with a reduced length of λ/8. The coupler is amenable to implementation on inexpensive low dielectric constant substrate material, still with a relatively wide coupling gap.

2 Claims, 2 Drawing Figures

SUSPENDED SUBSTRATE—3 dB MICROWAVE QUADRATURE COUPLER

TECHNICAL FIELD

The invention relates to microwave quadrature couplers outputting a coupled signal voltage lagging the direct signal voltage by 90° through the operating bandwidth, and more particularly to −3 dB couplers which output half of the received power at the coupled port and output the other half of the received power at the direct port.

BACKGROUND

Microwave circuitry is most easily manufacturable in microstrip and in stripline implementations. Microstrip circuitry has a single dielectric substrate layer with a ground plane on one side and microstrip conductors on the other side. Stripline circuitry has two dielectric substrate layers with the conductor array pattern sandwiched therebetween, and ground planes on the outer surfaces.

In either microstrip or stripline implementations, −3 dB couplers are not cost efficient manufacturable. This is because the coupling gap is too small, approaching zero. In either the Lange type interdigitated form or in a three level form, −3 dB couplers have thus been implemented. Even Lange type and three level type −3 dB couplers, however, involve considerable manufacturing cost.

A Lange type interdigitated −3 dB coupler, for example as shown in "Interdigitated Strip-Line Quadrature Hybrid", Julius Lange, 1969 *International Microwave Symposium,* Dallas, Texas, May 5–7, IEEE Cat. No. 69 C 6, pp. 10–13, employs a plurality of parallel interdigitated coupler lines spaced by narrow gaps. For high dielectric constant substrate material, for example alumina, i.e., aluminum oxide, the gap width is about 1 to 2 mils. These narrow gap widths and the plurality of conductor lines substantially increase manufacturing cost. On low dielectric constant substrate material, for example Teflon glass having a dielectric constant of about 2.2, the gap width would have to be on the order of 0.5 mil. This extremely narrow gap is even more difficult to fabricate, and from a pragmatic standpoint is probably not manufacturable, within reasonable limits of cost efficiency.

The other type of −3 dB coupler, the three level type, employs three dielectric substrate layers. The middle layer is sandwiched between conductor coupling lines, which are in turn sandwiched between the outer substrate layers, which are in turn sandwiched between outer ground planes. This structure is bulky, costly and difficult to incorporate with other microwave circuitry.

SUMMARY

The present invention provides a −3 dB microwave quadrature coupler that doesn't require narrow coupling gaps or multi-layer construction. The coupler is provided on a single dielectric substrate layer and uses only two conductor coupling lines. A relatively wide coupling gap is enabled, even on low dielectric constant substrate material. This wide coupling gap affords significantly easier manufacture and substantially reduces cost.

In the preferred embodiment, further cost savings are enabled by the invention because of its amenability to use with low dielectric constant substrate material, which is less expensive than high dielectric constant substate material. For example, in preferred form on a Teflon glass substrate of low dielectric constant of about 2.2, the gap width is about 3 to 4 mils.

Another significant aspect of the invention is its compact, reduced size. The length of the coupling conductor lines in the preferred embodiment is (λ/8) which is half the size of a Lange type coupler which has conductor lengths of (λ/4).

Another significant aspect of the invention is its compatibility with microstrip inputs. The coupler may thus be easily implemented in a system employing microwave circuitry.

Another significant aspect of the invention is the selectability of the gap width. This is because the characteristic impedance $Z_o$ can be adjusted by changing the line width.

In another desirable aspect of the invention, the coupler is completely coplanar and particularly easy to construct. A dielectric substrate is suspended within a mounting case providing a minimum spacing above and below the substrate. A ground plane is on the bottom of the substrate. Microstrip conductors are on the top of the substrate and connected to a pair of spaced parallel coplanar conductor lines on the top of the substrate juxtaposed a cut-out region of the ground plane therebelow. The coplanar conductor lines are balanced and tightly coupled to each other, and weakly coupled to the ground plane. The minimum spacing of the mounting case above and below the suspended substrate minimizes coupling of the coplanar conductor lines to the mounting case and enables a relatively wide coupling gap between the coplanar conductor lines. The width of the coupling gap, the width of the coplanar conductor lines and the height of the mounting case are selectable such that the even mode impedance $Z_{oe}$ approaches infinity or is much greater than $Z_o$, and the odd mode impedance $Z_{oo}$ equals $Z_o$, the characteristic impedance preferably being 50 ohms. The parallel conductor lines on the substrate are coupled at the ends thereof by a pair of capacitors, each capacitor providing a reactance substantially equal to the characteristic impedance.

BREIF DESCRIPTION OF THE DRAWINGS

FIG. 1 is a schematic top plan view of a coupler constructed in accordance with the invention.

FIG. 2 is a schematic cross-sectionally sliced view taken along lines 2—2 of FIG. 1, and further including the mounting case showing the suspension of the substrate. Conductors 26 and 30 and capacitor 34 are deleted from FIG. 2 for clarity of explanation.

DETAILED DESCRIPTION

Figure 1:
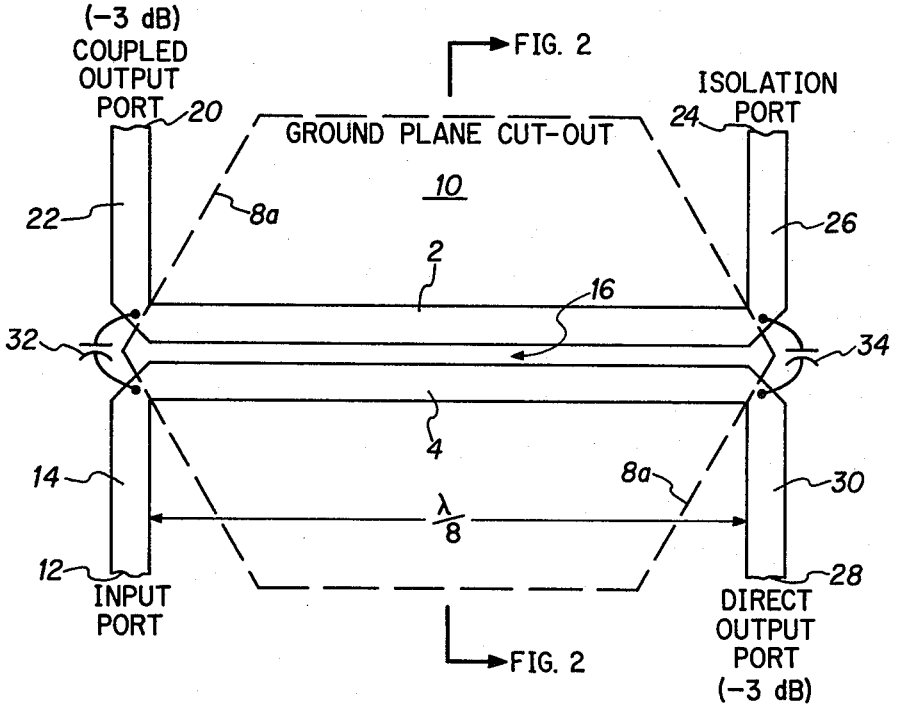
Figure 2:
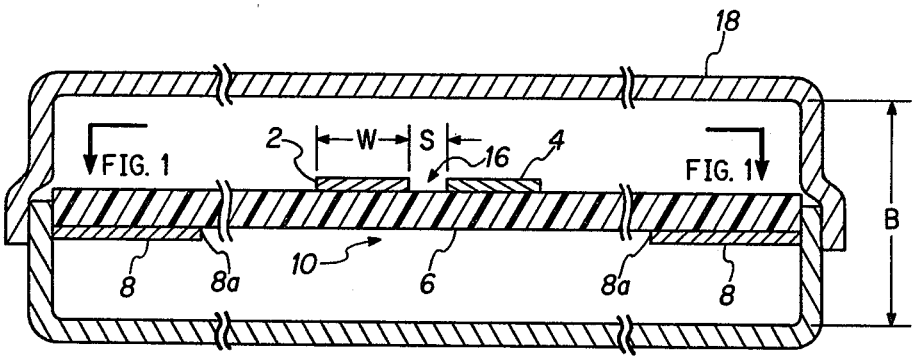

The −3 dB quadrature coupler of the present invention is provided by spaced parallel coplanar conductor lines 2 and 4 on top of a single layer dielectric substrate 6. A ground plane 8 is on the bottom of the substrate and is etched away along inner-perimeter boundary 8a to provide a cut-out region 10 juxtaposed below conductors 2 and 4.

An input port 12 is provided by a microstrip conductor 14 on top of substrate 6. The input signal on microstrip conductor 14 is unbalanced, with reference to ground plane 8 juxtaposed therebelow. Conductor 14 is continuous with conductor line 4, and the input signal is thus coupled from conductor line 4 across gap 16 to conductor line 2. Coplanar conductor lines 2 and 4 are balanced and coupled to each other. Neither conductor line 2 nor conductor line 4 are coupled to ground plane 8 because ground plane 8 has been cut out therebelow and because the cut-out boundary 8*a* is spaced from conductor lines 2 and 4 by a minimum spacing to prevent or at least minimize coupling between lines 2 or 4 and ground plane 8.

Substrate 6 is suspended in a mounting case 18 such that the coplanar coupling conductor lines 2 and 4 remain balanced to each other without ground-plane coupling to mounting case 18, or at least minimizing any coupling between lines 2 and 4 and case 18. Substrate 6 is mounted within case 18 in any suitable manner, for example by conductive epoxy at the edges of substrate 6. The height B of case 18 at cut-out region 10 is much greater than the width S of slot 16 such that there is a minimum spacing of the mounting case 18 above and below substrate 6 to prevent or minimize coupling of coplanar conductor lines 2 and 4 to mounting case 18.

The length of coplanar conductor lines 2 and 4 is $\lambda/8$. A coupled output port 20 is provided by microstrip conductor 22 which is unbalanced, coupled and referenced to ground plane 8 juxtaposed therebelow and spaced therefrom by substrate 6. An isolation port 24 is likewise provided by microstrip conductor 26, and a direct output port 28 is likewise provided by microstrip conductor 30. Microstrip conductor ports are thus provided on the top of the substrate and connected to the spaced parallel coplanar conductor lines 2 and 4.

The coupled output signal voltage at port 20 lags the direct signal output voltage at port 28 by 90 degrees through the operating bandwidth. Half of the power input to port 12 is output on the coupled port 20, and the other half of the input power is output on direct port 28.

In one implementation, low dielectric constant substrate material is used, for example Teflon glass having a dielectric constant of about 2.2. In this implementation, the width S of coupling gap 16 was about 3 mils, and the height B of the mounting case 18 across cut-out region 10 was about 1,000 mils (1 inch). It is generally preferred that B be greater than S by at least one order of magnitude. The width S of coupling gap 16 and the width W of coplanar conductor lines 2 and 4 are adjusted so that the even mode impedance $Z_{oe}$ approaches infinity or is much greater than $Z_o$, and the odd mode impedance $Z_{oo}$ is equal to $Z_o$, the characteristic impedance, preferably 50 ohms. Lumped capacitors 32 and 34, coupling the conductor lines 2 and 4 at the ends thereof, each have a reactance value $X_c$ chosen to equal the characteristic impedance $Z_o$, preferably 50 ohms. Other implementations employed coupling gap widths S ranging from 3 to 6 mils.

It is thus seen that the invention affords a microwave 90 degree quadrature hybrid −3 dB coupler on a single layer dielectric substrate and having a relatively wide coupling gap. The coupler is easily and cost-efficiently manufacturable. Only a single coupling gap is needed, and only two conductor lines are needed. The coupler is coplanar, and is implementable on low dielectric constant substrate material, further reducing cost. The coupler is compact, and only half the size of previous $\lambda/4$ length couplers.

It is recognized that various modifications are possible within the scope of the appended claims.

I claim:

1. A compact, reduced length microwave 90° quadrature −3 dB coupler comprising:

a dielectric substrate;

a ground plane on the bottom of said substrate;

microstrip conductor ports on the top of said substrate and connected to a pair of spaced parallel coplanar conductor lines separated by a coupling gap having a length of one eighth wavelength and juxtaposed a cut-out region of said ground plane therebelow such that said coplanar conductor lines are balanced and coupled to each other, said substrate being suspended within a mounting case such that the coplanar conductor lines remain balanced to each other without ground plane coupling to said mounting case and said coupling gap and the width of the conductor lines being selected so that the even mode impedance is very large and much greater than the characteristic impedance and so that the odd mode impedance is substantially equal to the characteristic impedance; and a pair of capacitors coupling the conductor lines at the ends thereof, said capacitors each providing a reactance substantially equal to the characteristic impedance, whereby said coupling gap can be made relatively wide and said conductor lines can be made substantially less than one quarter wavelength in length.

2. The coupler of claim 1, wherein said dielectric constant is around 2.

* * * * *